US006778044B2

(12) United States Patent
Fehrenbach et al.

(10) Patent No.: US 6,778,044 B2
(45) Date of Patent: Aug. 17, 2004

(54) COAXIAL LINE PLUG-IN CONNECTION WITH INTEGRATED GALVANIC SEPARATION

(75) Inventors: Josef Fehrenbach, Haslach (DE); Jürgen Motzer, Gengenbach (DE); Daniel Schultheiss, Hornberg (DE)

(73) Assignee: Vega Grieshaber KG (DE)

( * ) Notice: Subject to any disclaimer, the term of this patent is extended or adjusted under 35 U.S.C. 154(b) by 107 days.

(21) Appl. No.: 10/056,243

(22) Filed: Jan. 23, 2002

(65) Prior Publication Data

US 2003/0137372 A1 Jul. 24, 2003

(51) Int. Cl.[7] ..... H01P 1/04
(52) U.S. Cl. ..... 333/260; 439/578
(58) Field of Search ..... 333/24.2, 245, 333/254, 255, 260; 439/578, 585

(56) References Cited

U.S. PATENT DOCUMENTS

| | | | | | |
|---|---|---|---|---|---|
| 3,245,027 | A | * | 4/1966 | Ziegler Jr. | 439/585 |
| 3,309,632 | A | | 3/1967 | Trudeau | 333/33 |
| 3,757,278 | A | * | 9/1973 | Schumacher | 439/585 |
| 3,908,176 | A | * | 9/1975 | De Boer | 333/24 C |
| 3,936,116 | A | | 2/1976 | Spinner | 439/20 |
| 3,942,138 | A | | 3/1976 | Schaedla et al. | 331/21 R |
| 5,796,315 | A | | 8/1998 | Gordon et al. | 333/24 R |
| 6,146,196 | A | * | 11/2000 | Burger et al. | 439/578 |
| 6,388,538 | B1 | | 5/2002 | Meier | 333/24 R |
| 6,407,722 | B1 | * | 6/2002 | Bogner et al. | 343/906 |

FOREIGN PATENT DOCUMENTS

| | | | |
|---|---|---|---|
| DE | 198 56 339 | 6/2000 | H01P/1/203 |
| EP | 0882955 | 12/1998 | G01F/23/284 |

* cited by examiner

*Primary Examiner*—Robert Pascal
*Assistant Examiner*—Dean Takaoka
(74) *Attorney, Agent, or Firm*—Fay Kaplun & Marcin, LLP

(57) ABSTRACT

A plug-in connection comprises a plug and a socket having inner and outer conductors both connected with the coaxial line, and which are also constituted by an inner and an outer conductor. Within the plug-in connection, a dielectric material is provided for a galvanic separation of the outer conductor of the socket with respect to the outer conductor of the plug.

26 Claims, 5 Drawing Sheets

COAXIAL LINE PLUG-IN CONNECTION WITH INTEGRATED GALVANIC SEPARATION

FIELD OF THE INVENTION

The present invention relates to a coaxial line plug-in connection with a galvanic separation integrated therein. Such plug-in connections may, for example, be used in the area of the filling level measuring technology. For transmitting the HF module-generated microwave signals required for the filling level measurement to a transmitting and receiving unit such as a rod, horn or microstrip antenna, and for transmitting the reflected signals that are representative of the filling level height to be measured, back to an evaluation device, coaxial lines may be used.

Filling level measurements of that kind are necessary in almost all industrial branches. The filling products to be determined according to the filling level consist, e.g. in the chemical industry, of highly explosive materials. So as to prevent an explosion risk during the filling level measurement from arising in the inner space or the surroundings of a receptacle or a tank, lines to which different potentials are possibly applied, may be galvanically isolated. Alternatively hereto, it is also may be possible to provide a separate potential equalizing line. With the galvanic separation, two electric circuits may be completely separated from each other, no direct connection existing via a conducting material. The transmission of current or, in the present case of HF signals, usually ensues in the inductive way.

BACKGROUND INFORMATION

A coaxial HF plug-in connection is, for example, described in the document U.S. Pat. No. 3,936,116. In this plug-in connection, a signal transmission within the connector is improved by means of specific galvanic contact surfaces. A galvanic separation which is necessary for the required explosion-proof separation in the filling level measurement, however, is not realized. Such a galvanic plug-in connection may also be used in the area of the filling level measurement technology, an explosion-proof separation, however, has to be realized in another location, e.g. in the HF module. Thereby, a further interference-causing spot is present on the signal path from the HF module to the transmitting and receiving unit, whereby measurement results are possibly distorted.

A first kind of the galvanic separation of track conductors guiding HF signals on a circuit board, may be realized by capacitors, such as it is, for example, described in the document EP 0 882 955 A1. The galvanic separation ensues in this case by a microwave track conductor arranged as a coplanar track conductor, the galvanic separation being effected by means of capacitors on the circuit board. The coplanar circuit board guiding HF signals is comprised of three planar track conductor structures applied onto the circuit board running in parallel and being arranged in parallel with respect to each other, the middle track conductor serving as the signal track conductor, and the two lateral track conductors serving as screening track conductor. In both the signal track conductor and the screening track conductor, a capacitor is in each case inserted, whereby the galvanic separation is realized.

A further kind of separation may consists in the coupling by a dielectric material. Thus, it is also described, for example, in the document EP 0 882 955 A1 to couple the screening track conductor through the circuit board within the HF module. Here, as well, the track conductor guiding the HF signal is comprised of two parts, a signal track conductor and a screening track conductor.

As a further possibility, it is proposed in EP 0 882 955 A1 to couple both the screening and the signal track conductor by means of a dielectric material. The track conductors hereby are present within the HF module on both sides of a circuit board and exhibit a certain coupling zone.

It is believed that all of these described exemplary embodiments have in common that both the screening and the signal track conductor or fixedly applied onto a circuit board within the HF module. It is true that a retrofit of such a galvanic separation may be considered, but this will turn out as being extremely difficult due to the position within the HF module. Moreover, it may be regarded as being extremely problematic that by such a retrofit, an additional interference-causing spot arises on the signal path from the HF module to the transmitting and receiving unit.

SUMMARY OF THE INVENTION

An object of the an exemplary embodiment of the present invention is based on the problem of assuring the explosion-proof separation required for the explosion protection in the filling level measurement technology with a number as low as possible of interference-causing spots on the signal path between the HF module and the transmitting and receiving unit. The invention is inter alia directed to providing a plug-in connection which may be suitable for keeping the mounting effort at a possible minimum during an exchange of the electronic unit.

It is believed that this object is solved by a completely novel plug-in connection according to an exemplary embodiment of the present invention comprising, according to a first aspect of the invention, a plug and a socket. The plug, as well as the socket, are connected with a coaxial line. The coaxial line itself comprises an inner conductor serving as the signal line, as well as an outer conductor which may serve as a screening line. Both the socket and the plug possess an outer conductor on their part, which is in each case connected with the outer conductor of the coaxial line. The plug may be inserted into the socket in such a manner that the outer conductor of the plug overlaps over a determined length with the outer conductor of the socket, which length being referred to as coupling zone. The coupling between the outer conductors of the socket and the plug ensues at low frequencies (e.g. such as between 5 and 10 GHz) in a capacitive manner between the two overlapping outer conductors (coupling zone), which may be mutually insulated by a separating element of a dielectric material (preferably PTFE). For higher frequencies, e.g. between 24 and 28 GHz, this coupling zone may have a length of $\lambda/4$ with a wavelength $\lambda$ to be transmitted. Through this length adaptation, the no-load operation resulting at the end of the overlapping zone, transforms into a short-circuit at the discontinuity in the coaxial system.

It is believed that the coupling between the outer conductor of the socket and the plug ensues, as has already been mentioned, at low frequencies in a capacitive manner by a separating element made of a dielectric material, which is disposed between the outer conductor of the socket and the plug. The insulation thickness of the separating element between the two outer conductors and the coupling zone may be 0.5 mm. It is believed that by means of this prescribed minimum thickness, the necessary potential separation is fulfilled, which is required for explosion-proof areas, and which has to feature a voltage stability of 500 Volt.

According to another aspect of an exemplary embodiment of the invention, the plug part is configured still more simple as compared to the above embodiment. The socket construction hereby is identical to the socket of the first embodiment, the inner socket dimensions are, however, adapted to the smaller dimensions of the plug In this exemplary embodiment, a thicker so-called semi-rigid cable (e.g. UT141) may be used as the coaxial line. By using such a semi-rigid cable, the mounting effort during the fabrication of the plug is considerably reduced, since in contrast to the other embodiment, no separate plug component is required. On the contrary, the plug hereby may be comprised of an end of a stripped semi-rigid cable. The plug in the form of a stripped semi-rigid cable is thereby directly inserted into the socket.

As also in the above embodiment, a capacitive coupling between the two outer conductors serving as screening conductors for the cables may result in the lower frequency range. In the range of higher frequencies, a transformation of the no-load operation into a short-circuit is in turn obtained at the discontinuity in the coaxial system. For an optimum transformation of the short-circuit, the coupling zone in the socket may have a length of $\lambda/4$ with a wavelength $\lambda$ to be transmitted.

According to still another aspect of yet another exemplary embodiment of the invention, not only the screening line in a plug-in connection but also the signal line, may be coupled by means of an overlapping zone of a length of $\lambda/4$. Hereby, as well, a semi-rigid cable may be used as the coaxial line. In addition to coupling the screening line by a zone of a length of $\lambda/4$, the signal line in this embodiment may also be coupled by an overlapping zone of a length of $\lambda/4$. Hereby, capacitors separating the signal lines in the HF module such as it is usual in the prior art, become superfluous.

It is believed that a plug-in connection according to an exemplary embodiment of the present invention proves to be particularly advantageous in that, due to the anyway necessary plug-in connection and the galvanic separation contained in the plug-in connection, a reduction of the number of interference-causing spots in the signal path between the HF module and the transmitting and receiving unit is effected. Up to date, it is believed that always two components were necessary for this purpose. For one, the anyway necessary plug-in connection for connecting the transmitting and receiving unit with the coaxial line. For another, a galvanic separation by means of capacitors or a coupling by a dielectric material on a circuit board was necessary for the required explosion-proof separation. According to an exemplary embodiment of the present invention, one of these interference spots is cancelled in that the coupling is directly realized in the plug-in connection by a galvanic separation. The plug-in connection necessary for a simple exchange of the electronic unit, therewith is at the same time also the galvanic separation of the coaxial line.

It is believed that a further important advantage of the present invention resides in that by the centric arrangement of the plug-in connection in the sensor housing, which implies at the same time the galvanic separation of the coaxial line, a twisting movement of the transmitting and receiving unit with respect to the coaxial line guiding the signals, is enabled.

Moreover, it is believed that exemplary embodiments of the present invention prove to be very advantageous in the mounting effort necessary with an exchange of the electronic unit and which is kept very low thanks to the inventive plug configuration. When up to now, the cover had to be removed for exchanging the electronic unit for then being able to detach the HF cable or to screw it loose, the connection to the antenna system is already automatically separated by means of the inventive configuration upon pulling out the electronic insert.

It is believed that the mechanical requirements on inventive plug-in connections are very low in the coupling zone, since no electric connections have to be secured. Thereby, spring contacts are not necessary, whereby an insensitivity of the plug-in connection is guaranteed to the highest degree. Therewith results a very cost-efficient construction of an inventive plug-in connection.

The plug-in connection according to an exemplary embodiment of the present invention is believed to be advantageous in that by using a plug configuration of this type, the inner receptacle space may be hermetically closed with respect to the surroundings. Thus, in case a centric coupling is present on the waveguide, the plug-in connection of the galvanic separation may be directly plugged on the waveguide without using a HF cable. If, on the waveguide side e.g. glass or ceramics is used as the dielectric material (separating element), then a pressure-tight separation between the receptacle atmosphere and the inner space of the sensor housing may be achieved.

Apart from the already described advantages, it is believed that another advantage exists mainly by a configuration of the plug-in connection according to the above-mentioned exemplary embodiments in that the plug dimensions become particularly small by the use of a semi-rigid cable, and in that such plugs hence may be used in very constricted space conditions.

DETAILED DESCRIPTION

Figure 1:
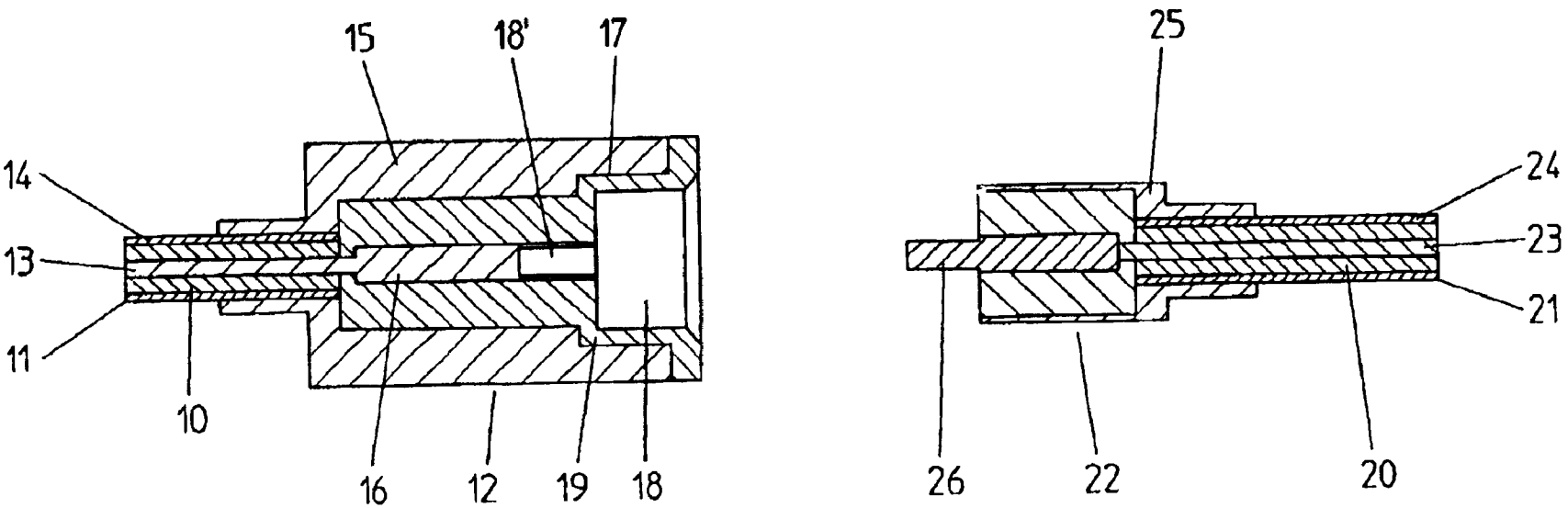
FIG. 1 shows a longitudinal cut of a plug-in connection according to a first exemplary embodiment of the present invention.

Throughout all Figures, identical parts are designated with corresponding reference numerals.

FIG. 1 is a longitudinal cut of a first exemplary embodiment through a plug-in connection according to the present invention. The plug-in connection is comprised of a socket 12 and a plug 22. To the socket 12, a coaxial line 11 is connected, which is in communication with a transmitting and receiving unit. The coaxial line 11 is comprised of an outer conductor 14 serving as a screening line, and of a signal guiding inner conductor 13. The inner conductor 13 and the outer conductor 14 are mutually insulated by a dielectric material 10. The outer conductor 14 of the coaxial line is in communication with the outer conductor of the socket 15. The inner conductor of the coaxial line is in communication with the inner conductor of the socket 16.

The coaxial line 21 likewise is comprised of a signal guiding inner conductor 23, and of an outer conductor 24 serving as a screening line, which are mutually insulated by a dielectric material 20. The outer conductor 24 is in communication with the outer conductor 25 of the plug 22. The inner conductor of the coaxial line is in communication with the inner conductor 26 of the plug 22.

On its side facing the plug, the socket 12 has a cup-shaped recess 18 configured such that the plug 22 fits into said recess. Following the cup-shaped recess 18, is a further, smaller cup-shaped recess 18', into which fits the inner conductor 26 of the plug 22. The cup-shaped recess 18 has a length of $\lambda/4$ in the insertion direction with a wavelength $\lambda$ to be transmitted. This zone is designated as the coupling zone 17 of the plug-in connection. The cup-shaped recess 18 is surrounded by a separating element 19 of dielectric material. The separating element features a minimum thickness of 0.5 mm, so as to ensure the prescribed insulation voltage of 500 Volt.

The coupling between the outer conductor 15 of the socket, and the outer conductor 25 of the plug 22 ensues in a capacitive manner at low frequencies between the two outer conductors 15 and 25 overlapping in the coupling zone 17. The outer conductors 15 and 25 thereby are mutually insulated by a separating element 19 (which may consist of PTFE). So as to ensure the transmission of higher frequencies, the coupling zone 17 may have a length of $\lambda/4$ with a wavelength $\lambda$ to be transmitted. It is believed that due to this matching of the coupling zone 17 to the frequency to be transmitted, the no-load operation resulting at the end of the overlapping zone, transforms into a short circuit at the discontinuity in the coaxial system with a signal transmission being thereby guaranteed.

Figure 2:
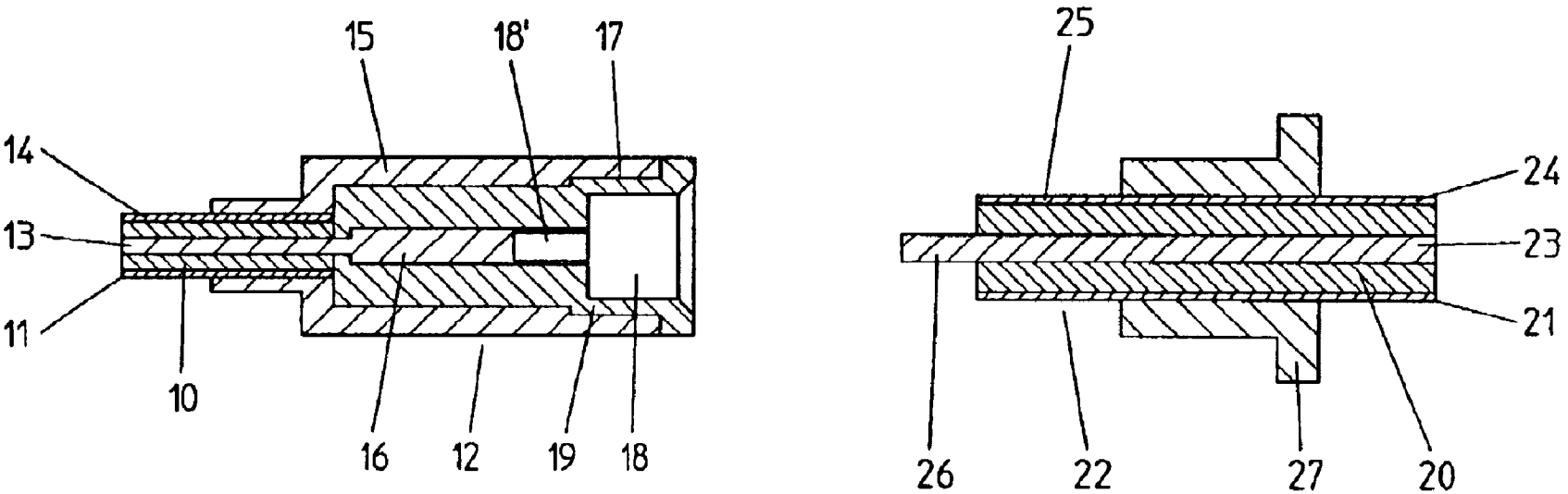
FIG. 2 shows a longitudinal cut of a plug-in connection according to a second exemplary embodiment of the present invention.

FIG. 2 is a longitudinal cut of a second exemplary embodiment through a plug-in connection according to the present invention. Here, the plug part is of a simpler configuration as compared to the first exemplary embodiment, in that a semi-rigid cable (e.g. UT141) is used as the HF cable, the inner conductor of which simultaneously constituting the plug contact for the signal line. Thereby, the mounting effort during fabrication of the plug may be considerably reduced.

The plug-in connection is comprised of a socket 12 and a plug 22. To the socket 12, a coaxial line 11 is connected, which is in communication with a transmitting and receiving unit. The coaxial line 11 is comprised of an outer conductor 14 serving as a screening line, and of a signal guiding inner conductor 13. The inner conductor 13 and the outer conductor 14 are mutually insulated by a dielectric material 10. The outer conductor 14 of the coaxial line is in communication with the outer conductor of the socket 15. The inner conductor of the coaxial line is in communication with the inner conductor of the socket 16.

The coaxial line 21 likewise is comprised of a signal guiding inner conductor 23, and of an outer conductor 24 serving as a screening line, which are mutually insulated by a dielectric material 20. The outer conductor 24 is identical with the outer conductor 25 of the plug 22. The inner conductor of the coaxial line is identical with the pin-shaped inner conductor 26 of the plug 22.

For mechanically fastening the HF cable 21 and the plug 22, respectively, on a housing (e.g. of an electronic unit insert), the plug 22 has a fastening flange 27 that separates the plug 22 in a geometrically graphic manner from the coaxial line following same. The fastening flange 27 on its part has bores or threads (not shown) serving the purpose of being fastened on a housing.

On its side facing the plug, the socket 12 has a cup-shaped recess 18 configured such that the plug 22 fits into said recess. Following the cup-shaped recess 18, is a further, smaller cup-shaped recess 18', into which fits the inner conductor 26 of the plug 22. The cup-shaped recess 18 has a length of $\lambda/4$ in the insertion direction with a wavelength $\lambda$ to be transmitted. This zone is designated as the coupling zone 17 of the plug-in connection. The cup-shaped recess 18 is surrounded by a separating element 19 of dielectric material. The separating element features a minimum thickness of 0.5 mm so as to ensure the prescribed insulation voltage of 500 Volt.

Here, as well, the coupling between the outer conductor 15 of the socket, and the outer conductor 25 of the plug 22 ensues in a capacitive manner at low frequencies between the two outer conductors 15 and 25 overlapping in the coupling zone 17. The outer conductors 15 and 25 thereby are mutually insulated by a separating element 19 (preferably of PTFE). For the transmission of higher frequencies, the transformation of the no-load operation into a short circuit applies again. For this purpose, the coupling zone 17 has a length of $\lambda/4$ with a wavelength $\lambda$ to be transmitted.

Figure 3A:
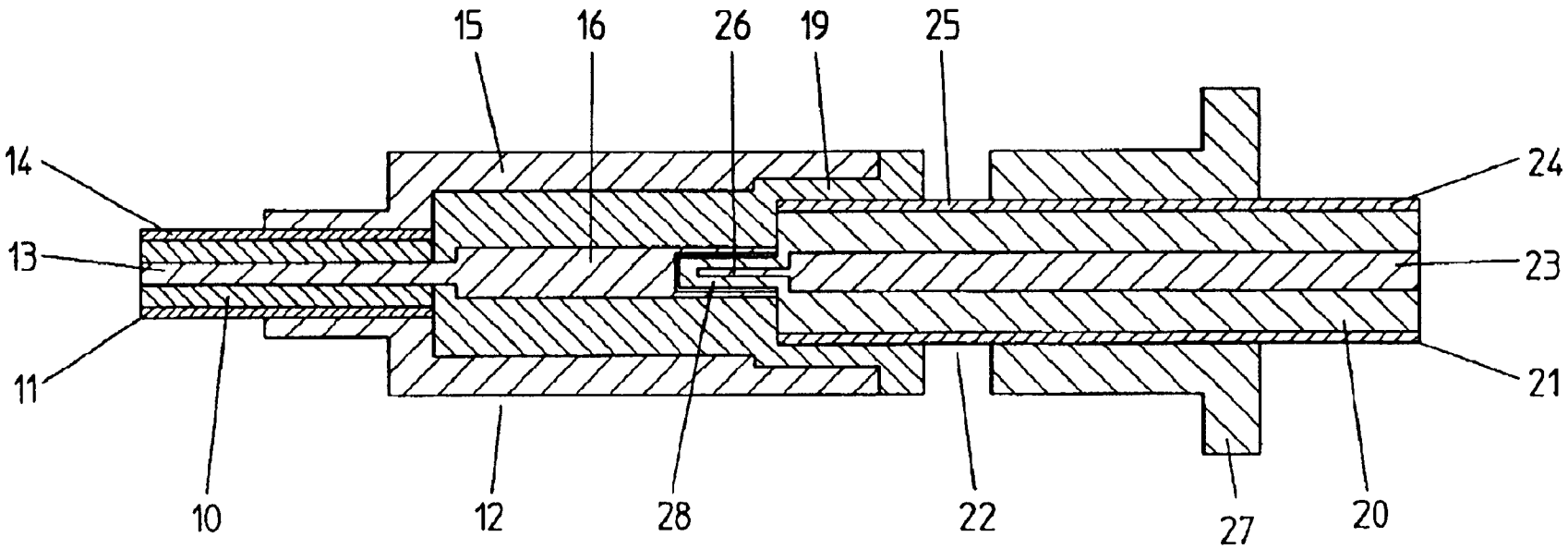
FIG. 3*a* shows a longitudinal cut of a plug-in connection according to a third exemplary embodiment of the present invention.

FIG. 3*a* is a longitudinal cut of a further exemplary embodiment through a plug-in connection according to the present invention. Both the plug 22 and the socket 12 thereby are mostly similar to the corresponding components of the second exemplary embodiment. In contrast to the second exemplary embodiment, however, a coupling of the signal line takes place in addition to the coupling of the screening line. Thus, the capacitors separating the signal line within the HF module according to the prior art, also become superfluous.

The plug-in connection is comprised of a socket 12 and a plug 22. To the socket 12, a coaxial line 11 is connected, which is in communication with a transmitting and receiving unit. The coaxial line 11 is comprised of an outer conductor 14 serving as a screening line, and of a signal guiding inner conductor 13. The inner conductor 13 and the outer conductor 14 are mutually insulated by a dielectric material 10. The outer conductor 14 of the coaxial line is in communication with the outer conductor of the socket 15. The inner conductor of the coaxial line is in communication with the inner conductor of the socket 16.

The coaxial line 21 likewise is comprised of a signal guiding inner conductor 23 and of an outer conductor 24 serving as a screening line, which are mutually insulated by a dielectric material 20. The outer conductor 24 of the coaxial line is identical with the outer conductor 25 of the plug 22. The inner conductor 26 finds its continuation in a pin-shaped inner conductor 26 of the plug 22, which is surrounded by a separating element 28 of a dielectric material (the dielectric material may be PTFE).

For mechanically fastening the HF cable 21 and the plug 22, respectively, on a housing (e.g. of an electronic unit insert), the plug 22 has a fastening flange 27 that separates the plug 22 in a geometrically graphic manner from the coaxial line following same. The fastening flange 27 on its part has bores or threads (not shown) serving the purpose of being fastened on a housing.

On its side facing the plug, the socket 12 has a cup-shaped recess 18 configured such that the plug 22 fits into said recess. Following the cup-shaped recess 18, is a further, smaller cup-shaped recess 18', into which fits the inner conductor 26 of the plug 22. The cup-shaped recesses 18 and 18' each have a length of λ/4 in the insertion direction with a wavelength λ to be transmitted. This zone is designated as the coupling zone 17 of the plug-in connection. The cup-shaped recess 18 is surrounded by a separating element 19 of dielectric material. The separating element 19 features a minimum thickness of 0.5 mm so as to ensure the prescribed insulation voltage of 500 Volt.

Due to this plug configuration, a coupling also of the signal line is possible in addition to the coupling of the screening line. As in the exemplary embodiments 1 and 2, the coupling in the lower frequency range ensues in a capacitive manner. For the transmission of higher frequencies, applies here as before the transformation of the no-load operation into a short circuit.

Figure 3B:
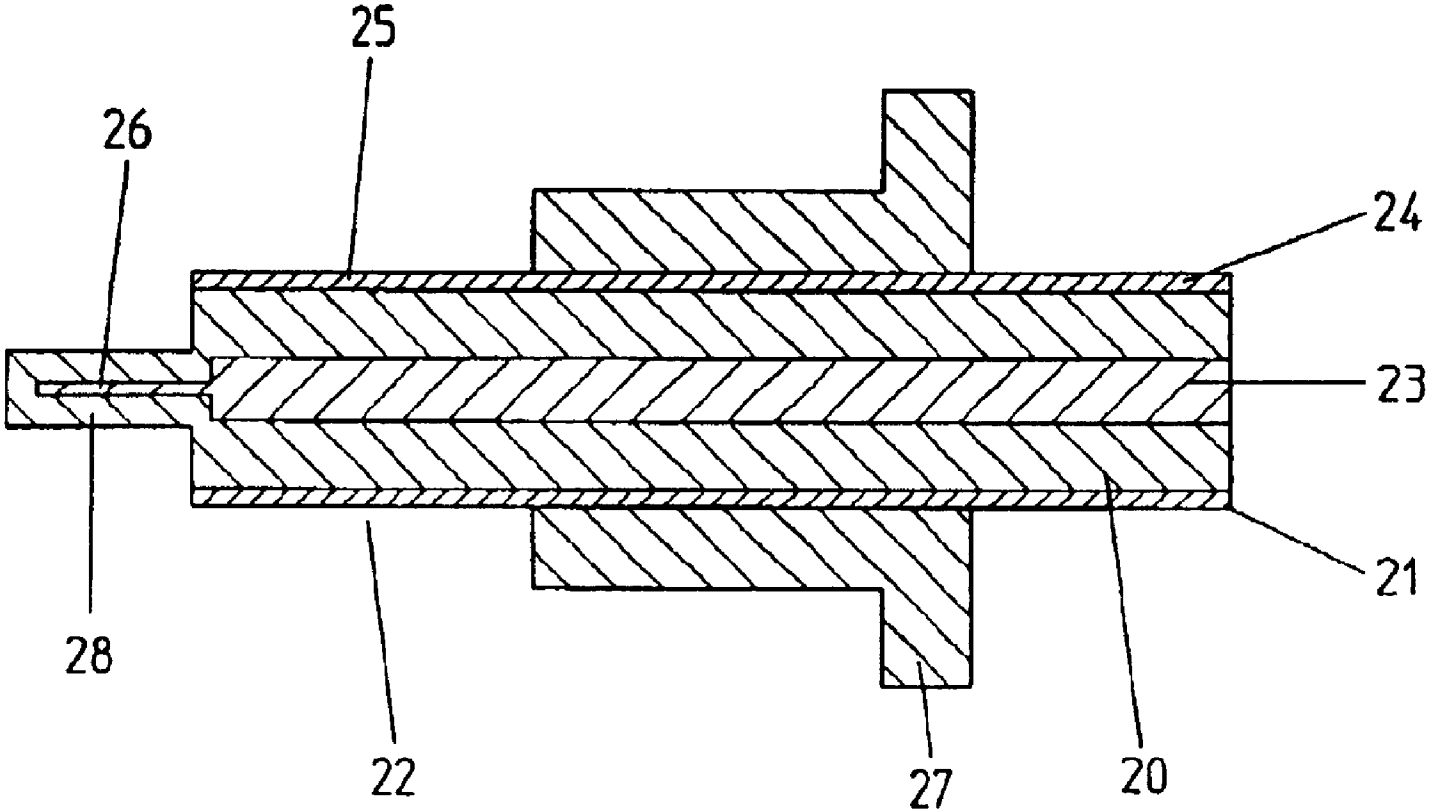
FIG. 3*b* shows a longitudinal cut of a variant of the plug according to the third exemplary embodiment.

In FIG. 3*b*, a variant of the plug 22 of the third exemplary embodiment is illustrated. In contrast to the plug 22 of the third exemplary embodiment, the separating element 28 is not situated within the socket, rather it surrounds the inner conductor 26 of the plug 22 as a component of the plug 22.

Figures 4A, 4B:
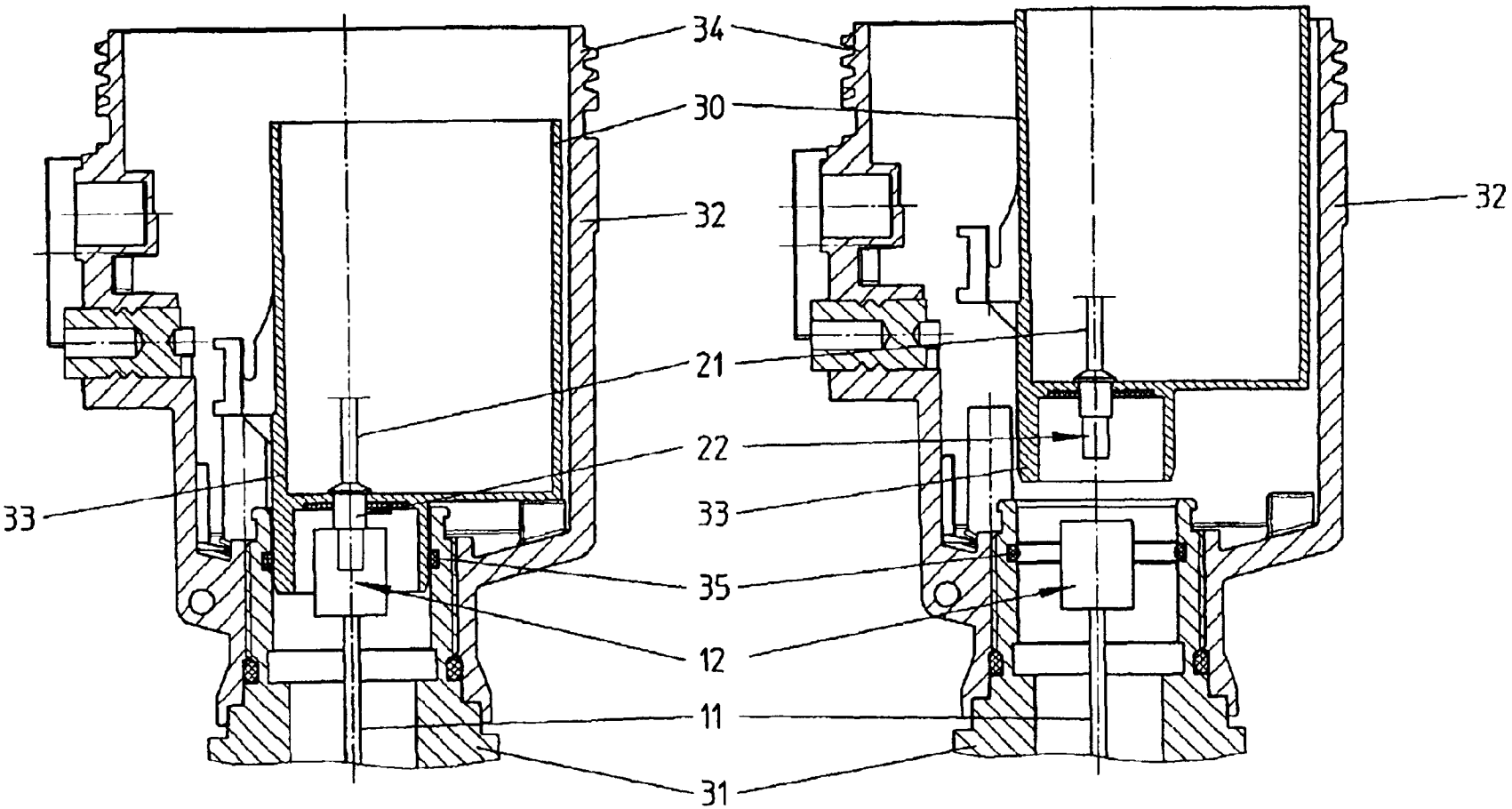
FIG. 4*a* shows an exemplary embodiment of a transmitting and receiving unit using a plug-in connection according to the present invention in the non-inserted state.
FIG. 4*b* shows another exemplary embodiment of a transmitting and receiving unit using a plug-in connection according to the present invention in the inserted state.

The FIGS. 4*a* and 4*b* illustrate the installation of the inventive plug-in connection in a sensor. FIG. 4*a* shows in an exemplary manner the installation in a transmitting and receiving unit of a plug-in connection according to the present invention in the non-inserted state.

The plug 22, which is in communication with the coaxial line 21, thereby protrudes through the bottom wall of the housing of the electronic unit 30. The plug 22 thereby protrudes into a cup-shaped guide 33 of the electronic unit insert 30, which guide i; supposed to ensure a proper guidance during insertion, as well as a protection of the plug during insertion. The housing of the electronic unit 30 is situated within the inner space of the sensor housing 30. The sensor housing 30 can be closed with a cover (not shown) via the thread 34. Lying opposite the plug 22 in the axial direction is the socket 12, which is arranged in the entry zone leading to the antenna 31.

If one views FIG. 4*b*, which represents the sensor including the inventive plug-in connection in the inserted state, then it can be recognized how the guide 30 is pushed into the neck-shaped entry zone of antenna 31 with the guide 30 being sealed with respect to the antenna entry zone by means of the O-ring 35. The plug-in connection therewith is insensitive against ambient conditions.

The sensor housing 34 together with the housing of the electronic unit 30 including the plug 22, can be rotated relative to the antenna 31 and the socket 12. An exchange of the electronic unit 30 is enabled by simply pulling out the electronic unit insert. The removal of a cover according to the prior art for being able to remove the coaxial line, is cancelled.

What is claimed is:

1. A socket for coupling two coaxial lines each comprised of an inner conductor and an outer conductor surrounding the inner conductor, and which are suited for transmitting microwave signals of the wavelength λ, wherein a first coaxial line of the two coaxial lines can be plugged into the socket, the socket comprising:

at least one separating element which is arranged in the socket and which covers the end face of the socket;

wherein the socket is comprised of a dielectric material; and wherein a galvanic separation of the outer and inner conductors is effected by the at least one separating element at a λ/4-coupling zone.

2. The socket according to claim 1, wherein the socket is directly attached to a waveguide for centrically coupling the microwave signals into the waveguide.

3. A coaxial line plug-in connection for connecting a first end of a first coaxial line and a second end of a second coaxial line, wherein each of the first and second coaxial lines has an inner conductor and an outer conductor and wherein the outer conductors surround the inner conductors, the coaxial line plug-in connection comprising:

a socket having an end face;

a plug;

a separating element; and a λ/4-coupling zone;

wherein the separating element is of a dielectric material for galvanically separating at least the outer conductors of the first and second coaxial lines;

wherein the separating element further covers the end face of the socket; and wherein the socket and the plug couple the first end and the second ends on the λ/4-coupling zone for transmitting microwave signals of a wavelength λ between the first and second coaxial lines.

4. The coaxial line plug-in connection according to claim 3, wherein the separating element is arranged in the socket.

5. The coaxial line plug-in connection according to claim 3, wherein the separating element consists of at least one material selected from the group consisting of PTFE, ceramics and glass.

6. The coaxial line plug-in connection according to claim 3, wherein the plug has a radially exterior lateral wall face;

wherein the socket has a radially interior lateral wall face; and wherein, when the first end and the second end are inserted in the coaxial line plug-in connection, the radially exterior lateral wall face and radially interior lateral wall face lie opposite in the coupling zone and are spaced apart by the separating element.

7. The coaxial line plug-in connection according to claim 6, wherein the coupling zone has an axial direction;

wherein the coupling zone receives the separating element; and wherein the coupling zone has a length of λ/4 in the axial direction.

8. The coaxial line plug-in connection according to claim 6, wherein the separating element is arranged ring-shaped in the coupling zone between the exterior lateral wall face of the plug and the interior lateral wall face of the socket.

9. The coaxial line plug-in connection according to claim 8, wherein the ring-shaped separating element has a minimum wall thickness of 0.5 mm.

10. A coaxial line plug-in connection for coupling a first end of a first coaxial line and a second end of a second coaxial line, wherein each of the first and second coaxial lines has an inner conductor and an outer conductor and wherein the outer conductors of the first and second coaxial lines surround the inner conductors of the first and second coaxial lines, the coaxial line plug-in connection comprising:

a socket having an end face;

a plug;

a separating element; and a λ/4-coupling zone;

wherein the plug is comprised of one of the first and second ends;

wherein the separating element is of a dielectric material for galvanically separating at least the outer conductors of the first and second coaxial lines;

wherein the separating element further covers the end face of the socket; and wherein the socket and the plug couple the first end and the second ends on the λ/4-coupling zone for transmitting microwave signals of a wavelength λ between the first and second coaxial lines.

11. The coaxial line plug-in connection according to claim 10, wherein the separating element is arranged in the socket.

12. The coaxial line plug-in connection according to claim 10, wherein the separating element consists of at least one material selected from the group consisting of PTFE, ceramics and glass.

13. The coaxial line plug-in connection according to claim 10, further comprising:

a fastening flange which is attached to the plug;

wherein an inserted state of the socket and the plug is ensured by means of the fastening flanged attached to the plug.

14. The coaxial line plug-in connection according to claim 10, wherein the plug has a radially exterior lateral wall face comprised of the outer conductor, beyond which protrudes the inner conductor in a pin-shape;

wherein the socket has a radially interior lateral wall face; and wherein, in an inserted state, the radially exterior lateral wall face and radially interior lateral wall face lie opposite each other in the coupling zone spaced apart by the separating element.

15. The coaxial line plug-in connection according to claim 14, wherein the coupling zone has an axial direction and receives the separating element; and wherein the coupling zone has an optimum length of λ/4 in the axial direction.

16. The coaxial line plug-in connection according to claim 14, wherein a further dielectric material is arranged ring-shaped in the coupling zone between the exterior lateral wall face of the plug and the interior lateral wall face of the socket.

17. The coaxial line plug-in connection according to claim 16, wherein the further ring-shaped dielectric material has a minimum wall thickness of 0.5 mm.

18. A coaxial line plug-in connection for coupling a first end of a first coaxial line and a second end of a second coaxial line, wherein each of the first and second coaxial lines has an inner conductor and an outer conductor and wherein the outer conductors of the first and second coaxial lines surround the inner conductors of the first and second coaxial lines, the coaxial line plug-in connection comprising:

a socket having an end face;

a plug having an end face;

at least one separating element; and at least one λ/4-coupling zone;

wherein the plug is comprised of one of the first and second ends;

wherein the at least one separating element is of a dielectric material for galvanically separating the inner conductors and the outer conductors of the first and second coaxial lines;

wherein the at least one separating element farther covers the end faces of both the socket and the plug; and wherein the socket and the plug couple the first end and the second ends on the at least one λ/4-coupling zone for transmitting microwave signals of a wavelength λ between the first and second coaxial lines.

19. The coaxial line plug-in connection according to claim 18, wherein the at least one separating element is arranged in the socket.

20. The coaxial line plug-in connection according to claim 18, wherein the at least one separating element consists of at least one material selected from the group consisting of PTFE, ceramics and glass.

21. The coaxial line plug-in connection according to claim 18, further comprising a fastening flange;

wherein the fastening flange is attached to the plug; and wherein an inserted state of the socket and the plug is ensured by means of the fastening flange attached to the plug.

22. The coaxial line plug-in connection according to claim 18, wherein the at least one separating element comprises a first separating element and a second separating element;

wherein the plug has a radially exterior lateral wall face comprised of a first outer conductor of the outer conductors of the first and second coaxial lines;

wherein a first inner conductor of the inner conductors of the first and second coaxial lines protrudes beyond the first outer conductor in a pin-shape;

wherein the socket has a first radially interior lateral wall face and a second radially interior lateral wall face;

wherein the radially exterior lateral wall face of the plug and the first radially interior lateral wall face of the socket, in an inserted state, lie opposite each other spaced apart by the first separating element in a first λ/4-coupling zone, whereto follows a second λ/4-coupling zone in which the first inner conductor lies opposite the second interior lateral wall face of the socket spaced apart by the second separating element.

23. The coaxial line plug-in connection according to claim 22, wherein the pin-shaped inner conductor is surrounded by a third separating element.

24. The coaxial line plug-in connection according to claim 22, wherein the first and second separating elements are each arranged ring-shaped.

25. The coaxial line plug-in connection according to claim 24, wherein the first and second separating elements have a minimum wall thickness of 0.5 mm.

26. The coaxial line plug-in connection according to claim 22, wherein the first and second coupling zones have first and second axial directions;

wherein the first and second coupling zones receive the at least one coupling element; and wherein the first and second coupling zones each have an optimum length of λ/4 in the first and second axial directions.

* * * * *